United States Patent [19]

Caputo et al.

[11] Patent Number: 4,566,597

[45] Date of Patent: Jan. 28, 1986

[54] MODULAR SUPPORT UNIT

[76] Inventors: Mario A. Caputo, 4905 Avenue "M"; Jeffrey C. Caputo, 4903 Avenue "M", both of Brooklyn, N.Y. 11234

[21] Appl. No.: 521,159

[22] Filed: Aug. 8, 1983

[51] Int. Cl.[4] ..... A47F 5/08

[52] U.S. Cl. ..... 211/87; 248/110; 108/152; 312/206

[58] Field of Search ..... 211/88, 49 R, 59.1, 211/86, 184, 94; 217/65; 206/820; 248/108, 110, 225.1, 223.4; 108/152; 312/206, 207

[56] References Cited

U.S. PATENT DOCUMENTS

| | | | |
|---|---|---|---|
| 2,248,916 | 7/1941 | Opper | 248/108 X |
| 2,616,647 | 11/1952 | Murchison | 248/110 |
| 3,468,571 | 9/1969 | Farmer | 403/381 |
| 4,094,271 | 6/1978 | Louis | 206/820 X |
| 4,209,098 | 6/1980 | Adams | 211/94 X |
| 4,325,485 | 4/1982 | Pina et al. | 248/110 X |

FOREIGN PATENT DOCUMENTS

| | | | |
|---|---|---|---|
| 924232 | 1/1955 | Fed. Rep. of Germany | 211/94 |
| 2450582 | 11/1980 | France | 211/94 |
| 362182 | 7/1962 | Switzerland | 248/108 |
| 14433 | of 1910 | United Kingdom | 211/94 |

*Primary Examiner*—Robert W. Gibson, Jr.
*Assistant Examiner*—Blair M. Johnson
*Attorney, Agent, or Firm*—Natter & Natter

[57] ABSTRACT

A modular support unit mountable within a bathroom wall cabinet provides a space organizer for storage of safety razors, toothbrushes, shaving brushes and similar personal care articles. A base member is attachable to a vertical surface and a selective arrangement of cantilever support arms are slideably engageable within a channel formed in the base member. The support arms are downwardly inclined toward the vertical surface and define slotted openings for gravity assisted stacking of the articles.

6 Claims, 3 Drawing Figures

FIG. 1
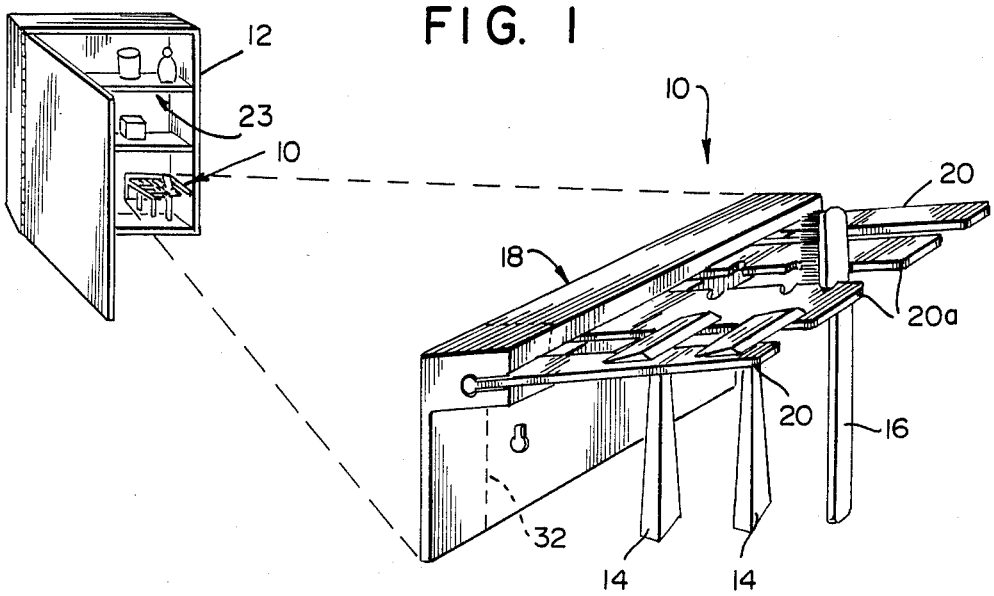
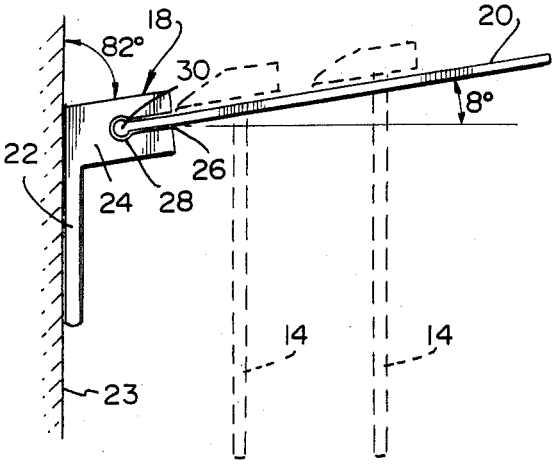
FIG. 2
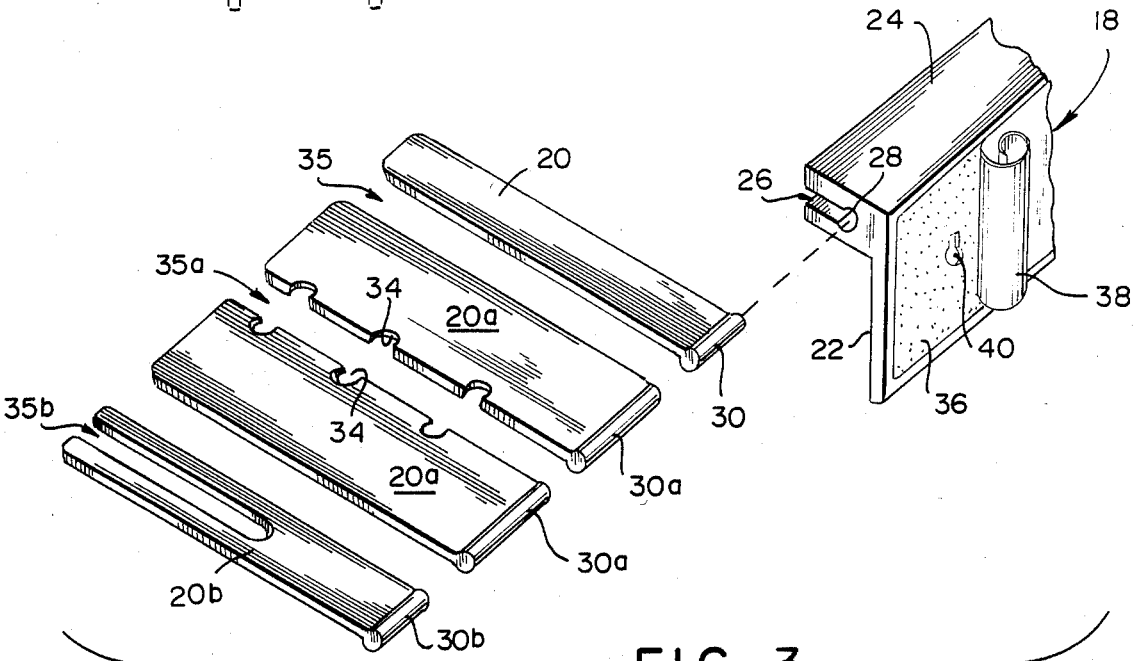
FIG. 3

MODULAR SUPPORT UNIT

TECHNICAL FIELD

This invention concerns receptacles and especially to a mounting bracket for supporting personal care articles.

In particular, this invention relates to a modular support unit for the stackable storage of safety razors, toothbrushes and similar items.

BACKGROUND ART

The average family generally utilizes several individual personal care articles such as safety razors, shaving brushes, toothbrushes, etc. These items are commonly stored within a bathroom wall cabinet. The cabinets were frequently supplied with horizontal shelves and toothbrush racks mounted to the inside surface of the cabinet door. Because of the limited space availability within the cabinets, there was a tendency for clutter and disorderliness. Another problem was that the door mounted racks were only suitable for holding articles of restricted sizes which did not extend beyond the shelves when the door was closed.

Another disadvantage of those bathroom storage facilities was that they did not provide a space-saving organizer for depositing shaving and dental appliances. Prior attempts to provide mounting brackets for shaving equipment were shown in U.S. Pat. Nos. 1,102,284, 2,969,140, 3,954,499 and 4,266,664. Those devices as shown were not intended for stackable storage of diverse personal care articles and furthermore, did not utilize a modular assembly or have a readily adjustable length and selectively positionable support arms.

DISCLOSURE OF THE INVENTION

Briefly, the nature of this invention involves a modular support unit mountable within a bathroom wall cabinet for providing a space-saving organizer. The device is intended for the stackable storage of shaving and dental appliances and other similar articles.

In summary the device of this invention concerns a modular support unit having a base member secureable to a vertical surface and a flexible arrangement of cantilever support arms. The support arms are selectively positionable within a channel in the base member to define a slotted opening between adjacent arms for slidably accommodating and stacking the personal care items. In another embodiment, the confronting edge surfaces of adjacent support arms are provided with notches for accommodating tooth cleaning implements. A variant support arm has a bifurcated free end forming an article receiving slot.

An end of the support arm is provided with a cylindrical bead adapted for complementary fit within a cylindrical recess in the base member for locking engagement. Furthermore, the support arms are inclined downwardly toward the vertical surface for providing positive gravity assisted stacking, water runoff from the stored items, and sanitary air-drying.

The base member is additionally provided with an adhesive backing for convenient securement to the vertical surface and alternatively a keyhole aperture can be used for attachment to a screw-head. Another feature relating to the flexible assembly concerns the placement of score marking in the base member at regularly spaced intervals which provide a guide when cutting the base member or otherwise adjusting the length dimension for accommodation within an enclosure.

In view of the foregoing, it should be apparent that the present invention overcomes many of the shortcomings of the prior art and provides an improved modular support unit.

Having thus summarized the invention, it will be seen that it is an object thereof to provide a modular support unit of the general character described herein which is not subject to the aforementioned disadvantages.

Another object of this invention is to provide a modular support unit having interfitting components which are adaptable for mounting within a cabinet enclosure to provide a space-saving organizer.

A further object of this invention is to provide a modular support unit having plural cantilever support arms selectively positionable and forming receiving slots for accommodating personal care articles.

Yet another object of this invention is to provide a modular support unit which is simple in construction, low in cost, reliable in use and well adapted for mass production fabrication techniques.

Other objects of this invention in part will be apparent and in part will be pointed out hereinafter.

With these ends in view, the invention finds embodiment in certain combinations of elements, and arrangements of parts by which the aforementioned objects and certain other objects are hereinafter attained, all as fully described with reference to the accompanying drawings and the scope of which is more particularly pointed out and indicated in the appended claims.

BRIEF DESCRIPTION OF THE DRAWINGS

In the accompanying drawings in which are shown some of the various possible exemplary embodiments of the invention:

FIG. 1 is a perspective view of a modular support unit in accordance with this invention showing an isolated projection to an enlarged scale from a mounting within a cabinet enclosure;

FIG. 2 is a side elevational view illustrating a base member secured to a vertical support surface and a cantilever arm support with several safety razors in a stacked storage mode; and FIG. 3 is a partial perspective view shown in exploded fashion and illustrating assembly of the cantilever support arms and their interfitting relationship with the base member, including alternate versions of the support arms.

BEST MODE FOR CARRYING OUT THE INVENTION

Referring now in detail to the drawings, the reference numeral 10 denotes generally a modular support unit of this invention.

The modular support unit 10 is constructed with a base member 18 and a plurality of cantilever support arms 20, 20*a*, 20*b*. The base member 18 includes a backplate 22 which is adapted for securement to a substantially vertical support surface such as a rear wall 23 of the cabinet enclosure 12. An integral flange portion 24 extends from one end of the backplate 22 at an angle of approximately 82° from the plane of the backplate member 22. As will be apparent hereinafter, the support arms 20, 20*a*, 20*b* will accordingly be downwardly inclinded toward the vertical surface at an angle of approximately 8° from the horizontal as shown inK FIG. 2.

The flange portion 24 is provided with a channel 26 terminating at a cylindrical recess 28. Each of the cantilever support arms 20, 20*a*, 20*b* is a substantially planar member having a respective cylindrical projection or bead 30, 30*a*, 30*b* coincident with a transverse edge. The thickness dimension of the support arms 20, 20*a*, 20*b* and of the respective cylindrical bead 30, 30*a*, 30*b* are adapted for complimentary slideable accommodation within the channel 26 and the cylindrical recess 28 with the bead 30, 30*a*, 30*b* providing lockable securement. The tolerance between the interfitting components are intended for providing a snug fit with each of the arms 20, 20*a*, 20*b* being substantially coplanar and sloped to permit gravity assisted loading and drainage for promoting air-drying of the safety razors and toothbrushes. It should also be noted that the confronting linear edges of the support arms 20, 20*a*, 20*b* define a receiving slot 35 therebetween the width of which can be variably adjusted for accommodating the aforementioned articles.

In this preferred embodiment, the base member 18 and the cantilever support arms 20, 20*a*, 20*b* are constructed of a durable thermoplastic such as plexiglass although equivalent materials could also be substituted. With regard to typical dimensions, the transverse length of the base member is approximately 10 cms. In order to facilitate installation within confined areas a score line 32, as typically illustrated in FIG. 1, is placed at incremental locations such as every 1 cm. and thus provides a guide for trimming the base member 18 during the mounting procedure. The length of the cantilever support arms 20, 20*a*, 20*b* is approximately 7 cms. and the width dimension is about 2.5 cms. with a thickness of about 3 mm.

In connection with the variant support arms 20*a*, the confronting edges between adjacent support arms 20*a* define a receiving slot 35*a* and further include a series of complimentary notches 34. The notches 34 provide clearance for seating articles such as the toothbrush 16 which is loaded in a sidewise position and then rotated within the notch 34 to a forwardly facing storage mode. The support arm 20*b* illustrates another version which includes a bifurcated end defining a receiving slot 35*b* for similarly supporting the safety razor 14 or like items.

The mounting of the device 10 to the support surface 23 is accomplished by providing the backplate member 22 with an adhesive surface 36 and a peelable protective covering 38. An alternate procedure is to provide a plurality of keyhole apertures 40 for attachment over a screw or nail head projecting from the wall 23. It should be apparent that the cantilever support arms 20, 20*a*, 20*b* can be selected in accordance with the personal care articles that are to be supported by the device 10. In addition, it is contemplated that the component element of the device 10 may be packaged as a kit for assembly by the purchaser and further that standardized cantilever support arms can be secured to the base member 24.

Thus, it will be seen that there is provided a modular support unit which achieves the various objects of the invention and which is well adapted to meet conditions of practical use.

Since various possible embodiments might be made of the present invention or various changes might be made in the exemplary embodiment set forth, it is to be understood that all materials shown and described in the accompanying drawings are to be interpreted as illustrative and not in a limiting sense.

Having thus described the invention, there is claimed as new and desired to be secured by Letters Patent:

1. A modular support unit for stackable storage of safety razors and other personal articles comprising a base member having a backplate attachable to a substantially vertical surface, a flange portion extending from said backplate, said flange portion defining a channel coextensive therewith and having at least one open end, said channel further defining a recess therein, a plurality of interchangeable modular support arms having attachment means along a transverse edge, said support arms being substantially planar and slidably positionable within said channel through an open end, said attachment means interfitting within the recess for securing the support arm with the support arm projecting from the channel and being downwardly inclined toward the backplate, said support arms further defining an article receiving slot between a pair of confronting longitudinal edges, said slot having a width dimension being variably adjustable by substantially parallel slidable positioning of the support arms within the channel, said slot further having a length dimension adaptable for accepting a plurality of articles, with said articles being storable in gravity-assisted stacked relationship, said longitudinal confronting edges of the slot defining a plurality of complementary notch means for providing additional width dimension along the length of the slot for adjustable positioning of said articles within the slot.

2. A modular support unit as claimed in claim 1 wherein at least one of said support arms is bifurcated with said bifurcation providing a receiving slot.

3. A modular support unit as claimed in claim 1 wherein the attachment means along the transverse edge defines a cylindrical bead coincident with the edge.

4. A modular support unit as claimed in claim 3 wherein the channel recess is cylindrical and adapted for slidably accommodating the cylindrical bead.

5. A modular support unit as claimed in claim 4 wherein the support arms are sloped toward the backplate at an angle of approximately 8 degrees from a horizontal plane.

6. A modular support unit as claimed in claim 3 wherein the base member defines transverse score line break means for providing frangible incremental length adjustment.

* * * * *